US005894690A

United States Patent [19]

Lehrman

[11] Patent Number: 5,894,690

[45] Date of Patent: Apr. 20, 1999

[54] REINFORCED IRONING BOARD COVER

[76] Inventor: David Lehrman, 207 Barclay Cir., Cheltenham, Pa. 19012

[21] Appl. No.: 08/587,074

[22] Filed: Jan. 16, 1996

[51] Int. Cl.[6] ..... D06F 83/00

[52] U.S. Cl. ..... 38/140

[58] Field of Search ..... 38/140, 66, 137; 156/91, 93, 182, 181; 150/154, 165; 428/68, 71, 244, 304.4, 920; 2/7, 81; 5/738

[56] References Cited

U.S. PATENT DOCUMENTS

| | | | |
|---|---|---|---|
| 2,382,141 | 8/1945 | Dawson et al. | 38/66 |
| 2,490,981 | 12/1949 | Reiss et al. | 38/66 |
| 2,539,714 | 1/1951 | Young et al. | 38/140 X |
| 2,570,110 | 10/1951 | Glatt | 38/140 |
| 2,814,135 | 11/1957 | Freeman | 38/140 X |
| 3,911,603 | 10/1975 | Lehrman . | |
| 4,043,062 | 8/1977 | Lehrman | 38/140 |
| 4,360,984 | 11/1982 | Ruttenberg | 38/140 |
| 4,768,253 | 9/1988 | Boyd et al. | 5/464 |
| 4,798,760 | 1/1989 | Diaz-Kotti | 442/35 |
| 5,136,723 | 8/1992 | Aldridge et al. | 2/81 |
| 5,644,811 | 7/1997 | Cavazos | 5/738 |

FOREIGN PATENT DOCUMENTS

| | | | |
|---|---|---|---|
| 746627 | 3/1956 | United Kingdom | 38/140 |

*Primary Examiner*—Ismael Izaguirre

*Attorney, Agent, or Firm*—Seidel, Gonda, Lavorgna & Monaco, PC

[57] ABSTRACT

A wrinkle-free ironing board cover comprises a layer of fabric, a layer of padding, and a layer of a thermoplastic polymer sheet material, preferably a sheet in the form of a mesh. The thermoplastic polymer sheet layer imparts increased bursting and tear strength to the ironing board cover.

24 Claims, 3 Drawing Sheets

REINFORCED IRONING BOARD COVER

FIELD OF THE INVENTION

The invention relates to ironing board covers and more particularly to an ironing board cover having a padding layer, a fabric outer layer and a reinforcing layer of durable fabric intermediate the padding and fabric outer layers.

BACKGROUND OF THE INVENTION

Typically, ironing board covers consist of a padding underlayer and a fabric top layer. The fabric top layer comprises the ironing surface. The padding layer can be coextensive with the padding fabric layer. Alternatively, the padding layer may be sized the same as the ironing board to be covered and the fabric layer is larger than the padding so that a marginal integral skirt is defined between the edges of the padding and the edge of the fabric layer. This construction is shown in U.S. Pat. No. 3,911,603. The fabric and padding layers may be joined by an adhesive.

The padding, which is typically a layer of foam polymeric material of approximately ¼ inch thickness, (approximately 6.4 mm) does not substantially contribute to the tensile strength of the cover. The fabric layer, typically made of cotton or a heat resistant fabric, provides the ironing board cover with structural integrity. However, the fabric cover may become weakened due to wear from repeated use, resulting in a loss of burst strength. The adhesive which is applied to bind the fabric layer to the padding layer does not contribute to tensile strength. What is needed is an ironing board cover which combines resistance to wrinkling with enhanced structural integrity and burst strength.

SUMMARY OF THE INVENTION

A wrinkle-free ironing board cover is provided comprising a layer of fabric, a layer of padding, and a layer between the fabric and padding layers comprising a thermoplastic polymer sheet. The thermoplastic polymer sheet is advantageously in the form of a mesh. The preferred thermoplastic sheet material is polypropylene.

The thermoplastic polymer sheet and padding preferably have the same size and shape of the surface of an ironing board to be covered. The fabric layer preferably has the same shape as the padding layer, but a larger size than the padding layer. The portion of the fabric layer extending beyond the edge of the padding layer forms a marginal skirt integral with the layer of fabric. The cover includes means, such as an elastic strip or drawstring, to secure the cover to an ironing board. The marginal skirt is of sufficient width to enable the edges of the fabric layer to underlie the ironing board to be covered when the cover is secured thereon by the securing means. A drawstring is confined in a space along the edge of the fabric layer, formed by the fabric layer edge and a welting doubled over the fabric layer edge.

DETAILED DESCRIPTION OF THE INVENTION

Figure 1:
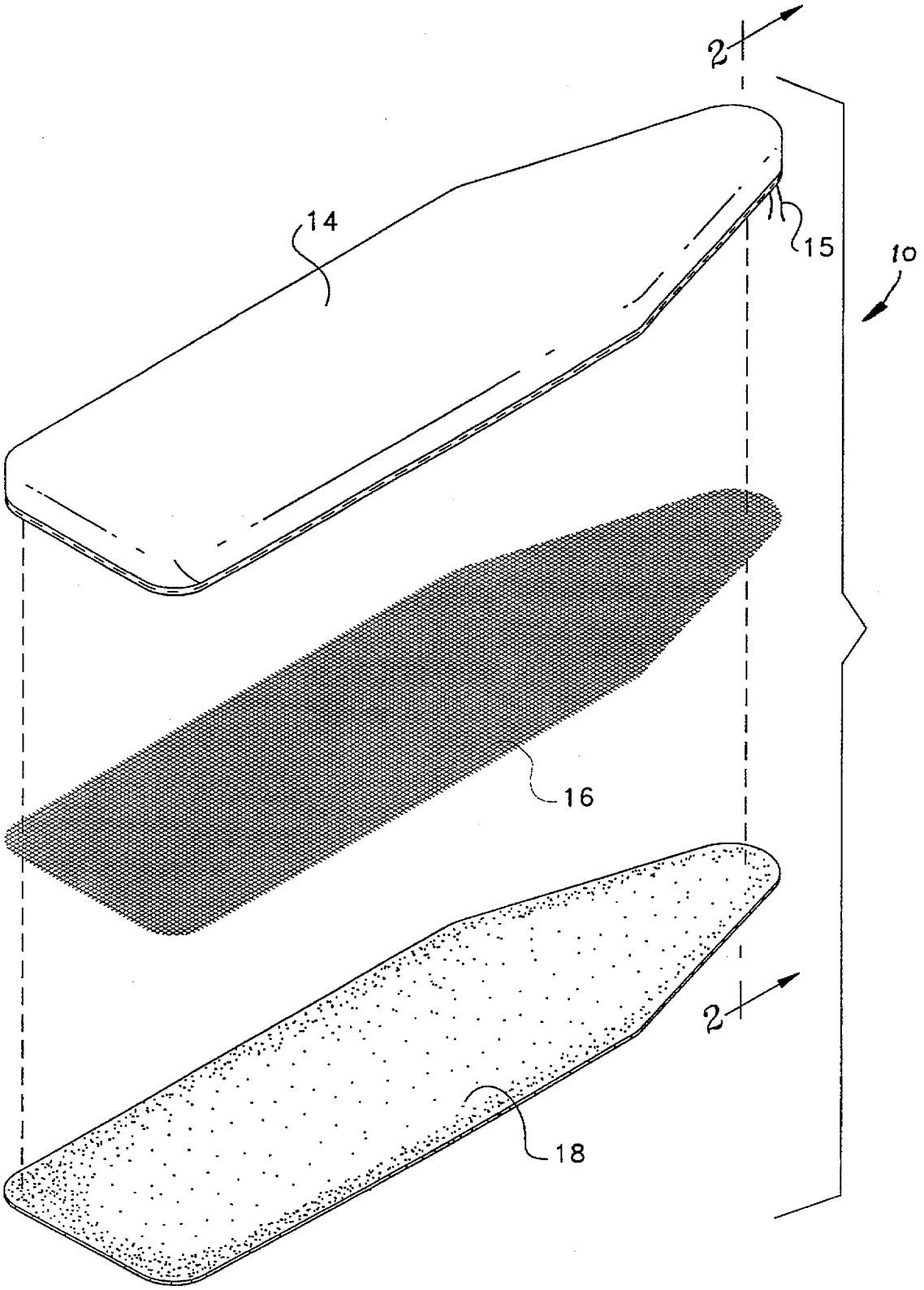
FIG. 1 is an exploded perspective view of the ironing board cover of the invention.

According to the present invention, the strength of a laminated ironing board cover consisting of fabric and padding layers, which may be optionally bonded together by an adhesive, is enhanced by the inclusion of an intermediate layer of a thermoplastic sheet material. The thermoplastic sheet may be formed of fibers of a thermoplastic polymer. Many thermoplastic polymers may be processed into fibers by melt spinning, melt blowing, and the like. Sheets of thermoplastic material may also be formed by extrusion casting. Preferably, the sheet is formed by joining, such as by weaving or melt processing, fibers of a thermoplastic polymer material.

The sheet of thermoplastic polymeric material increases the bursting strength and tear strength of the laminate. Bursting strength is the ability of a material to resist rupture by pressure. As applied to fabrics, bursting strength is typically viewed as the force required to rupture a fabric by distending it with a force applied at right angles to the plane of the fabric under specified conditions. The thermoplastic polymer sheet layer also serves to inhibit movements of the warp and fill yarns of the fabric layer of the cover, thereby inhibiting abrasion of the cover in the ironing process.

According to one preferred embodiment of the invention, the thermoplastic sheet is in the form of a mesh. The mesh size may vary according to the degree of burst strength to be imparted. Preferably, the mesh size is from about ¼ to about ½ inch (about 6–4 mm to about 1.3 cm) with about ⅜ inch (about 9.5 mm) being preferred.

The preferred polymeric thermoplastic material for forming the polymeric sheet layer is polypropylene, most preferably a sheet formed of polypropylene fiber. Polypropylene fiber is produced by melt spinning molten polypropylene, followed by stretching to orient the fiber molecules. Polypropylene has a high work of rupture, which indicates a tough fiber, and may be made with tenacities as high as 8.0 to 8.5 grams per denier. By "polypropylene" is meant any polymer formed of repeating monomer units of propylene. The term polypropylene as used herein is meant to include not only homopolymers of propylene, but also copolymers thereof with small amounts of other monomer units.

While in a preferred embodiment of the invention, the thermoplastic polymer sheet layer comprises virgin polypropylene, a modified polypropylene may be employed wherein polypropylene has been compounded with other materials such as, e.g., asbestos or glass fibers, or blended with other synthetic polymers. The term "polypropylene" as used herein is intended to embrace such modified polypropylene materials.

According to one preferred embodiment of the invention, the polypropylene layer consists of a mesh formed from virgin polypropylene, such as the mesh ON 3230 of Conwed Plastics, Inc. ON 3230 has a Vicat softening point of 154° C. (310° F.) and a melting temperature of 175° C. (347° F.), a nominal strand count of 2.8 strands per inch (about 1.1 strands per cm) in the machine direction and 3.0 strands per inch (about 1.2 strands per cm) in the cross direction, a tensile strength of 12 pounds per three inches in the machine direction and 8.5 pounds per three inches in the cross direction.

The thermoplastic polymer sheet layer, in addition to conferring added burst and tear strength to the ironing board cover, can serve to bind the padding and fabric layers together. The bonding renders the fabric layer essentially wrinkle-proof. The wrinkle-proof nature of the cover can be further enhanced by further bonding the layers together with an optional adhesive, such as a thermoplastic adhesive.

According to one method of manufacturing the ironing board cover, the laminate of padding, thermoplastic sheet material and fabric layer is subject to pressing in a conventional press, such as at temperatures of 330–450° F. about 166–232° C. The thermoplastic sheet material placed between the fabric and padding layers can be selected so as to melt, or at least significantly soften, at the pressing temperatures. The melting and then solidifying of the thermoplastic sheet between the padding layer and fabric layers serves to bind the two layers to one another thereby, providing a wrinkle-free cover.

The fabric layer is preferably formed from a durable heavyweight fabric which will resist the heat imparted during normal ironing temperatures. Such fabrics are standard in the art and will not be discussed herein. The padding layer consists of foam padding of the type conventionally employed in ironing board covers. The padding is preferably foam polyurethane. While the padding may have any thickness, approximately ¼ inch (approximately 6.4 cm) is adequate. The padding layer is substantially thicker than either the fabric layer or polypropylene mesh layers.

An optional adhesive may be included to further bond the layers of the ironing board cover together and to prevent slippage of one layer against the other. According to one embodiment of the invention, the fabric, padding and polypropylene layers are bonded together by a thermoplastic adhesive and the application of heat and pressure. The preferred adhesive is a thermoplastic polymer with heat reactive cross-linking groups. One such material is NACRYLIC X-4260 of National Starch and Chemical Corporation. NACRYLIC X-4260 is a soft, self-reactive acrylic emulsion having 51% solids, a pH of 3.0, a viscosity of 150 cps (2 @20, 72° F.), an anionic particle charge, an average particle size of 0.2μ, and a density of 8.8 lbs/gal. at 72° F. (22° C.) During use, a slight softening of the adhesive may take place at ironing temperatures. The softening of the adhesive has the effect of permitting initial wrinkles to be ironed out of the cover, allowing a wrinkle-free cover to be maintained.

Figure 3:
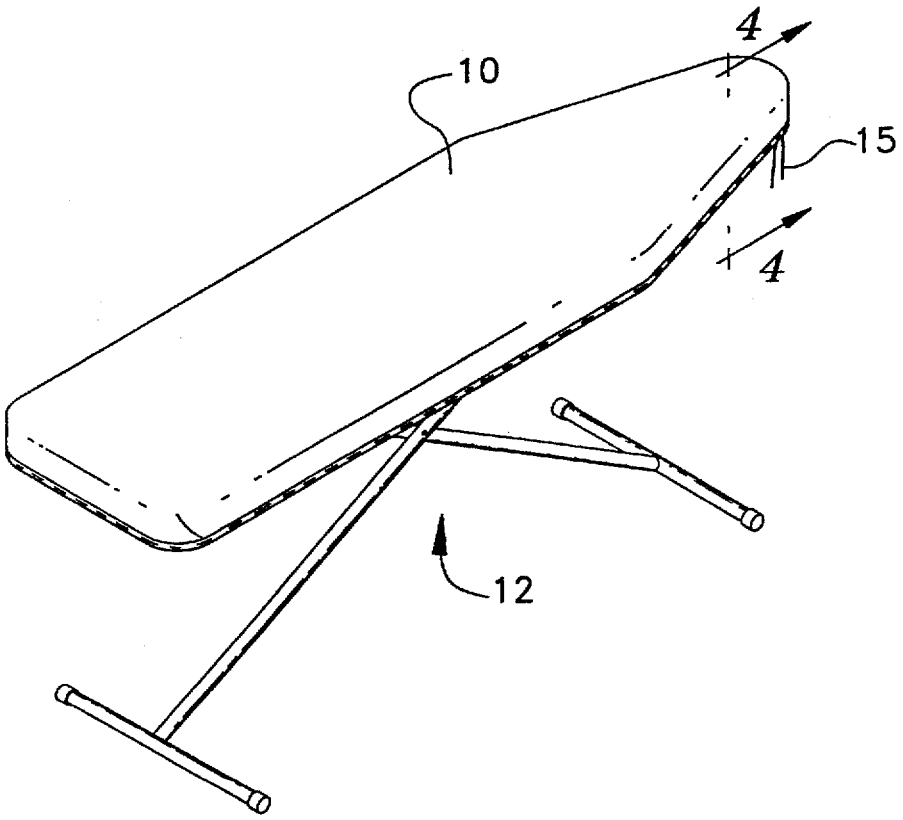
FIG. 3 is a perspective view of an ironing board with the cover installed.

Referring to the drawings, FIG. 3 shows the ironing board cover installed on a conventional ironing table 12. Ironing board cover 10 is shown generally in FIG. 1, in exploded view. The nose portion is shown in broken view in FIG. 5. The ironing board cover 10 comprises a layer of fabric 14 having the general outline of an ironing board. The edges of the fabric layer 14 may have an optional binding or welting 26 formed by stitching 20, through which a drawstring 15 may pass. The welting may consist of a strip of fabric which is doubled over and stitched over the edge of the fabric layer to provide a conduit for the drawstring. See FIG. 4.

Figure 4:
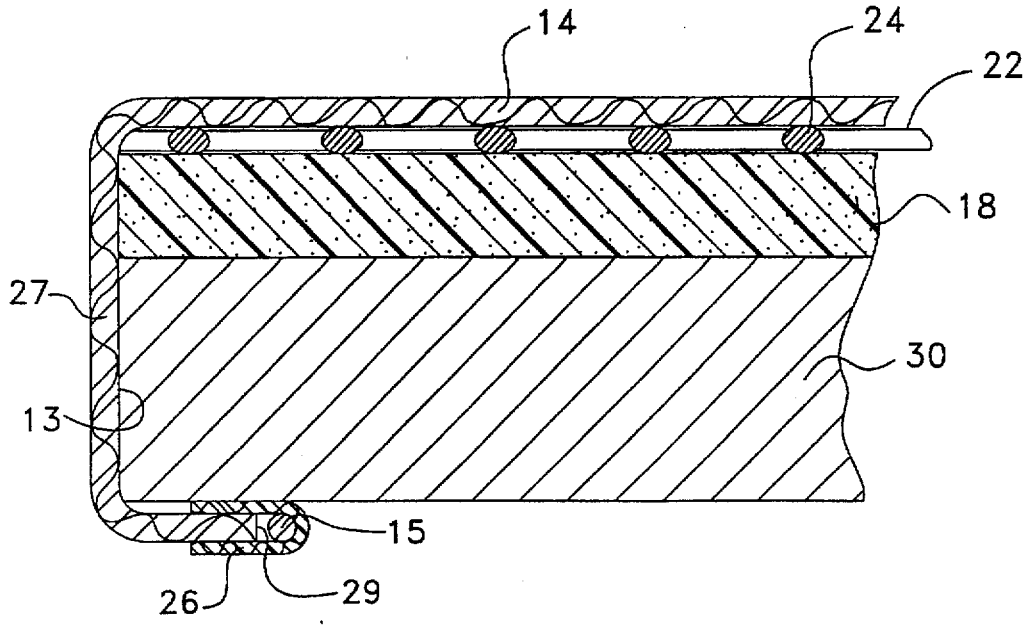
FIG. 4 is a sectional view of the installed ironing board cover of FIG. 3 along line 4–4.

A padding layer 18 and polypropylene mesh 16 are also generally in the shape of an ironing board, and are preferably identically sized. Padding layer 18 and mesh 16 are preferably sized to have the identical dimensions of the ironing board to be covered. While the fabric layer 14 may have the same dimensions of the other two layers, it is preferred that the fabric layer has the same shape of the padding and mesh but with a marginal skirt extending outward for about two inches. As shown in FIG. 4, the marginal skirt forms an overhang 27 which may be turned down under the ironing board 30. The padding layer 18 and mesh 16 are coextensive with the edges 13 of the ironing board 30. Tightening of the drawstring 15, which runs in the space formed by welting 26 and fabric layer ledge 29, holds the cover in place on the ironing board.

Figure 2:
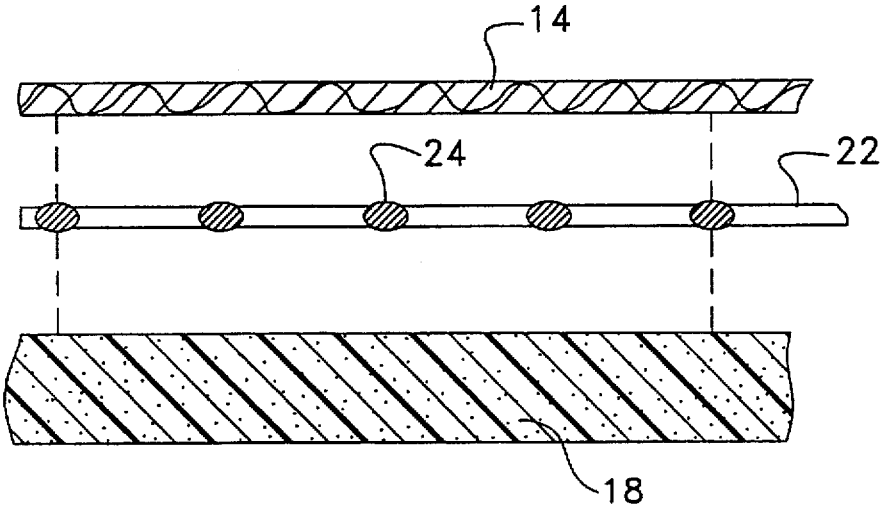
FIG. 2 is an exploded sectional view of the ironing board cover along line 2—2 in FIG. 1.
Figure 5:
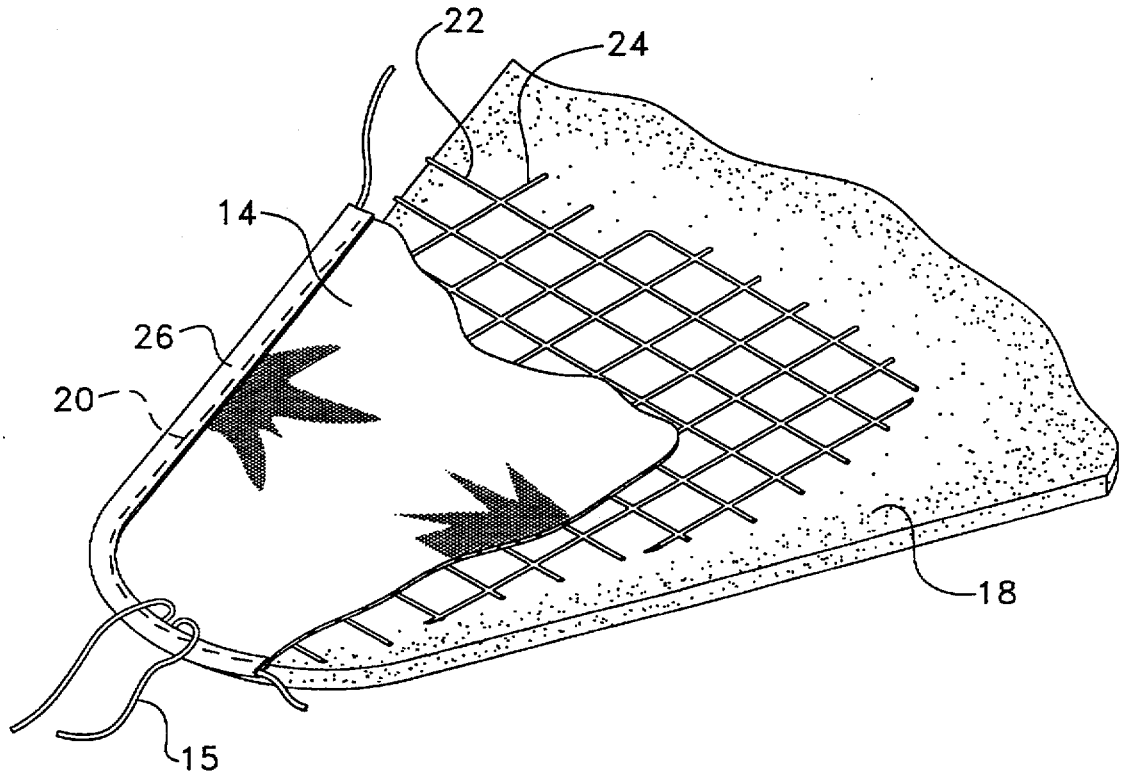
FIG. 5 is a perspective view, partially broken away, of the nose portion of the ironing board cover.

The triple layer construction of the uninstalled ironing board cover is further shown in the exploded cross section view of FIG. 2 and the broken view of FIG. 5. In FIG. 5, the cover is shown with the fabric marginal skirt lying flat. Welting 26 is held in place by stitching 20. The polypropylene mesh 16 is formed of a plurality of lateral (22) and longitudinal (24) strands of polypropylene filament. The mesh is sandwiched between fabric layer 14 and padding layer 18.

The laminated article of the invention may be prepared by applying an adhesive, preferably a thermoplastic adhesive, to one face of padding 18. The mesh 16 is laid over the adhesive-coated padding and additional adhesive is laid down on the mesh. The fabric layer is then put in place and the laminate is subjected to pressing in a conventional press. The surface area of the platen approximates the size of the ironing board, roughly 30 inches by 66 inches (roughly 76 cm by 168 cm). The top platen and bottom platens are heated to a temperature in the range of 330–450° F. (about 166–232° C.) Pressure is applied to compress the padding, but only to a depth of between about 1/16 to about ⅛ inch (about 1.6 to about 3.2 mm). The top platen is held in place at temperature to allow the curing of the thermoplastic adhesive and polypropylene mesh. The pressing time may be from about 3 to about 8 seconds.

The result is an ironing board cover which is more durable and has increased burst strength over covers of similar construction which lack an integral thermoplastic polymer sheet layer.

The present invention may be embodied in other specific forms without departing from the spirit or essential attributes thereof and, accordingly, reference should be made to the appended claims, rather than to the foregoing specification, as indication the scope of the invention.

I claim:

1. An ironing board cover comprising a layer of heat resistant fabric, a layer of padding, and a layer between the fabric and padding layers comprising a thermoplastic polymer mesh.

2. An ironing board cover according to claim 1 wherein the thermoplastic polymer mesh comprises a polypropylene mesh.

3. The ironing board cover of claim 2 wherein the polypropylene is virgin polypropylene.

4. The ironing board cover of claim 2 wherein the polypropylene is a modified polypropylene.

5. An ironing board cover according to claim 1 wherein the padding layer, fabric layer, and mesh are adhesively bonded together by an adhesive.

6. The ironing board cover of claim 5 wherein the adhesive is a thermoplastic adhesive.

7. The ironing board cover of claim 6 wherein the thermoplastic adhesive has the property of softening at ironing temperatures.

8. An ironing board cover according to claim 1 wherein the mesh and padding have substantially the same size and shape of the surface of an ironing board to be covered by the ironing board cover, and the fabric layer has substantially the same shape but a larger size than the padding layer, whereby the portion of the fabric layer extending beyond the edge of the padding layer forms a marginal skirt integral with the layer of fabric.

9. An ironing board cover according to claim 8 further comprising a means for securing the cover to an ironing board.

10. An ironing board cover according to claim 9 wherein the marginal skirt is of sufficient width to enable the edges of the fabric layer to underlie the ironing board to be covered when the cover is secured thereon by the securing means.

11. An ironing board cover according to claim 10 wherein the securing means is a drawstring.

12. An ironing board cover according to claim 11 wherein the drawstring is confined in a space along the edge of the fabric layer, formed by the fabric layer edge and a welting doubled over said fabric layer edge.

13. The ironing board cover of claim 1 wherein the mesh size is at least about ¼ inch (about 6.4 mm).

14. The ironing board cover of claim 13 wherein the mesh size is from about ¼ inch to about ½ inch (about 6.4 mm to about 1.3 cm).

15. The ironing board cover of claim 14 wherein the mesh size is about ⅜ inch (about 9.5 mm).

16. The ironing board cover of claim 1 wherein the layer of padding comprises polyurethane foam.

17. A method of making an ironing board cover comprising:

assembling a laminate comprising a layer of fabric, a layer of padding, and a layer between the fabric and padding layers comprising a thermoplastic polymer mesh, and pressing the laminate at a temperature sufficient to at least significantly soften the thermoplastic polymer mesh.

18. The method of claim 17 wherein the laminate also comprises a thermoplastic polymer with heat reactive cross-linking groups and the laminate is pressed at a temperature sufficient to initiate cross-linking.

19. The method of claim 17 wherein the mesh and padding have substantially the same size and shape of the surface of an ironing board to be covered by the ironing board cover, and the fabric layer has substantially the same shape but a larger size than the padding layer, whereby the portion of the fabric layer extending beyond the edge of the padding layer forms a marginal skirt integral with the layer of fabric.

20. The method of claim 18 wherein the mesh and padding have substantially the same size and shape of the surface of an ironing board to be covered by the ironing board cover, and the fabric layer has substantially the same shape but a larger size than the padding layer, whereby the portion of the fabric layer extending beyond the edge of the padding layer forms a marginal skirt integral with the layer of fabric.

21. An ironing board cover made according to the method of claim 17.

22. An ironing board cover made according to the method of claim 18.

23. An ironing board cover made according to the method of claim 19.

24. An ironing board cover made according to the method of claim 20.

* * * * *